US010760145B1

(12) United States Patent
Dudt et al.

(10) Patent No.: US 10,760,145 B1
(45) Date of Patent: Sep. 1, 2020

(54) APPARATUS AND METHOD FOR OUTER SURFACE ENHANCEMENT AND COMPACTION OF AN OBJECT USING GLASS FAILURE GENERATED PULSES IN AN EXPLOSIVE ARRANGEMENT

(71) Applicants: Philip Dudt, North Bethesda, MD (US); Roshdy George Barsoum, McLean, VA (US)

(72) Inventors: Philip Dudt, North Bethesda, MD (US); Roshdy George Barsoum, McLean, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 454 days.

(21) Appl. No.: 15/720,033

(22) Filed: Sep. 29, 2017

(51) Int. Cl.
*B21D 26/00* (2006.01)
*C21D 10/00* (2006.01)

(52) U.S. Cl.
CPC ..... *C21D 10/00* (2013.01); *B21D 26/00* (2013.01)

(58) Field of Classification Search
CPC ..... B21D 26/06; B21D 26/08; C21D 7/00; C21D 7/06; B22F 3/08; B01J 3/08
See application file for complete search history.

(56) References Cited

U.S. PATENT DOCUMENTS 4,655,830 A * 4/1987 Akashi ..... B01J 3/08 100/911
4,842,182 A 6/1989 Szecket
4,925,501 A * 5/1990 Harasek ..... B22F 3/08 148/101
7,832,614 B2 11/2010 Castelijns et al.

* cited by examiner

*Primary Examiner* — Debra M Sullivan
(74) *Attorney, Agent, or Firm* — Dave Ghatt

(57) ABSTRACT

An apparatus and method for treatment of articles, using glass failure generated pulses. The apparatus and method is directed towards the hardening and compaction of a glass-covered elongated object that is impacted by a flyer plate having a shape that is complimentary to that of the elongated object. The flyer plate is propelled by, an explosive reaction to create the impact on the glass-covered elongated object. This results in an explosive reaction that pressure-treats the elongated object, thereby causing the hardening and compaction.

8 Claims, 2 Drawing Sheets

APPARATUS AND METHOD FOR OUTER SURFACE ENHANCEMENT AND COMPACTION OF AN OBJECT USING GLASS FAILURE GENERATED PULSES IN AN EXPLOSIVE ARRANGEMENT

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

CROSS-REFERENCE TO RELATED APPLICATIONS

This application is related to U.S. Pat. No. 10,639,696, filed concurrently with the instant application, herein incorporated by reference, entitled "Apparatus and Method for Outer Surface Enhancement and Compaction of a Cylindrical Structure Using Glass Failure Generated Pulse," by inventors Philip Dudt and Roshdy George Barsoum.

This application is related to the pending U.S. Non Provisional patent application Ser. No. 15/719,951 filed concurrently with the instant application, herein incorporated by reference, entitled "Apparatus and Method for Outer Surface Enhancement and Compaction of a Spherical Structure Using Glass Failure Generated Pulse," by inventors Philip Dudt and Roshdy George Barsoum.

This application is related to U.S. Pat. No. 10,633,718, filed concurrently with the instant application, herein incorporated by reference, entitled "Apparatus and Method for Inner Cylindrical Surface Enhancement and Compaction of a Structure Using Glass Failure Generated Pulse," by inventors Philip Dudt and Roshdy George Barsoum.

TECHNICAL HELD

The following description relates generally to an apparatus and method for treating articles, using glass failure generated pulses. In particular, the apparatus and method is directed towards the hardening and compaction of a glass-covered elongated object that is impacted by a flyer plate having a shape that is complimentary to that of the elongated object, thereby initiating an explosive glass failure that hardens and compacts the elongated object.

BACKGROUND

There is always a need for stronger and harder alloys to improve the performance and lifetime of structures and platforms. Engineers are looking for high strength materials to improve performance and safety, while maintaining low weight requirements. Strength limitations directly affect how industrial parts are used, Engineers are actively looking for alloys with material properties sufficient for manufacturing and use, while providing fatigue, fracture, and corrosion resistance, while maintaining or improving mechanical properties.

Fatigue and fracture strengths of machinery parts, non-moving parts such as gun barrels, and weldments can be improved by generating high compressive strengths on their surface. The benefit is that the compressive stresses must be overcome before tension strains can be produced leading to crack initiation and extension. A number of known methods are used industrially for enhancing the surface strength profile. This includes the application of plastic stresses imparted using large rolling machines, carbonizing, shot peening, and explosive detonation. Explosive detonations are also employed for explosion welding, in which arrangements are also used to Many industrial parts, which cannot be otherwise produced by casting, rolling or forging can be fabricated using powder metallurgy techniques. The parts, such as gears, shafts, and brackets etc., are compacted and the powder with matrix portions are bonded together using hot isostatic pressing (HIP), along with follow-on heat application. Dynamically compressing parts under high dynamic loading is a useful process.

Another known technique for treating the surfaces of industrial parts to improve fatigue and fracture properties is shot peening. This technique enables a rise in the hardness of a surface layer of a work piece and introduction of compressive residual stress into the surface layer. This technique is widely used in the industrial fields of automobiles, aircrafts, etc.

Yet another known technique is laser shock hardening. This involves irradiating the surface of a solid material, such as a metal or a ceramic, with pulsed laser beam through a liquid to adjust surface of internal characteristics of the material, such as structure, hardness and residual stress. Generally speaking, laser shock hardening has a higher effect than shot peening and in addition has various excellent advantages that shot peening does not have, such as capability of contactless operation, no involvement of reaction force and capability of precise control of laser irradiation conditions and laser irradiation sites.

Regarding surface treatment that involves the bonding of two industrial parts together, it is known to employ explosion welding, particularly when the parts are metallic. In explosion bonding, two structures are placed on each other or in close proximity to each other, with a layer of explosive material positioned above the arrangement. When the explosion material is ignited and explodes, the two structures are pressed together powerfully to such extent that they melt together in the attachment zone. This melding of the two objects together and the accompanying deformation is not desired for the general machining and treatment of industrial parts.

Given what is known, it is still desired to have a method and an apparatus to improve the ability to strengthen and to make more compact, the surface of industrial parts, Such a method may also be used to supplement other forms of surface hardening, such as carburizing, nitriding and cyaniding.

SUMMARY

In one aspect, the invention is a system for hardening and compacting an elongated object. In this aspect, the system includes a confinement assembly. The confinement assembly includes, an elongated object having an upper surface, a glass sheet contacting and covering the upper surface of the elongated object, the glass sheet having an upper glass surface. The confinement assembly also includes a rigid outer shell encasing the glass sheet and the elongated object therewithin, wherein the rigid outer shell is open at the top so that the upper glass surface is exposed. The system also includes a striker assembly that includes a flyer plate having a flyer plate top surface, and a flyer plate bottom surface. The flyer plate bottom surface is complementary with the upper glass surface of the glass sheet. The striker assembly also includes an explosive composition attached to at least a portion of the flyer plate top surface. In this aspect, the flyer plate is positioned so that when the explosive composition is ignited, the flyer plate strikes the glass sheet of the confinement assembly, shattering the Mass of the glass sheet to create an explosive volume expansion of the glass. Due to the glass being trapped between the flyer plate and the confinement assembly, compressive forces are applied to the surface of the elongated object, thereby hardening and compacting the elongated object.

In another aspect, the invention is a method of hardening and compacting an elongated object. In this aspect, the method includes, providing a confinement assembly. The confinement assembly includes an elongated object having an upper surface, and a glass sheet contacting and covering the upper surface of the elongated object, the glass sheet having an upper glass surface. The confinement assembly also includes a rigid outer shell encasing the glass sheet and the elongated object therewithin, wherein the rigid outer shell is open at the top so that the upper glass surface is exposed. The method also includes providing a striker assembly. In this aspect, the striker assembly includes, a flyer plate having a flyer plate top surface, and a flyer plate bottom surface, wherein the flyer plate bottom surface is complementary with the upper glass surface of the glass sheet. The striker assembly also includes an explosive composition attached to at least a portion of the flyer plate top surface. The method further includes the igniting of the explosive composition, so that the flyer plate strikes the glass sheet of the confinement assembly, thereby creating an explosive expansion of the glass. In this aspect, due to the limited space between the flyer plate and the confinement assembly, compressive forces are created and applied to the surface of the elongated object, thereby accomplishing said hardening and compacting of the elongated object.

BRIEF DESCRIPTION OF THE DRAWINGS

Other features will be apparent from the description, the drawings, and the claims.

DETAILED DESCRIPTION

Figure 1:
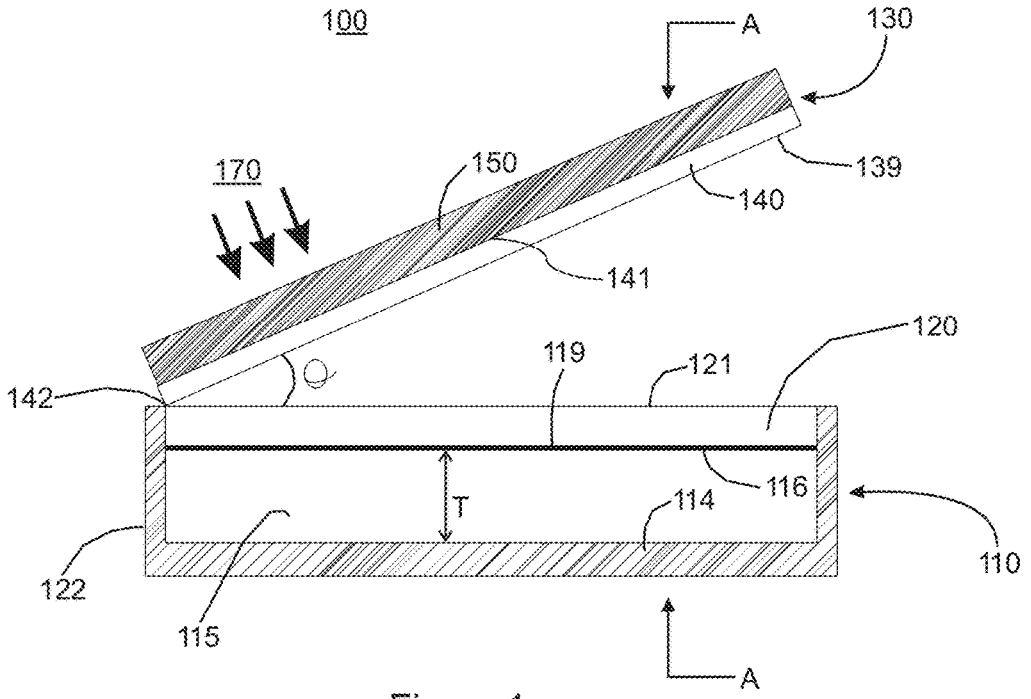
FIG. 1 is an exemplary side view of a system for hardening and compacting an elongated object, according to an embodiment of the invention.

FIG. 1 is an exemplary side view of a system 100 for hardening and compacting an elongated object, according to an embodiment of the invention. It should be understood that FIG. 1 shows the general arrangement of the elements of the system 100 with respect to each other. As outlined below, FIGS. 2A-2D below illustrate the different possible shapes of the elements arranged in FIG. 1.

The system 100 of FIG. 1 includes a confinement assembly 110 and a striker assembly 130. The confinement assembly 110 includes an elongated object 115, which may be a plate or the like. As shown, the elongated object 115 has an upper surface 116 and a lower surface 114, The elongated object 115 is to be hardened and compacted, as outlined below. The object 115 may be made from metallic materials such as 1015 steel, 4140 steel, and the like, and may be used as an industrial part in a mechanical operation, for example, and thus may be sized in accordance with the application. The object may have a thickness T of about 0.25 in to about. 3.0 in The confinement assembly 110 also includes a glass sheet 120 contacting and covering the upper surface 116 of the elongated object 115. The glass sheet 120 has an upper glass surface 121 and a lower glass surface 119. According to one embodiment of the invention, the glass sheet 120 is a solid glass plate, According to another embodiment of the invention, the glass sheet 120 is made up of densely packed glass particles. The glass may be for example, any known type of glass such as silica glass, fused silica, fluoride glass, alumino silicate glass, phosphate glass, borosilicate glass, or flint glass. The glass sheet 120 may include solid or densely packed glass particles.

FIG. 1 also shows a rigid outer shell 122 encasing both the glass sheet 120 and the elongated object 115. The rigid outer shell 122 may be a thick containment vessel, and may be open at the top so that the upper glass surface 121 is exposed. FIG. 1A shows the striker assembly 130 having a flyer plate 140 with a flyer plate top surface 141, and a flyer plate bottom surface 139. As outlined below, the flyer plate bottom surface 139 is complementary with the upper glass surface 121 of the glass sheet 120. The striker assembly 130 also includes an explosive composition 150 attached the top surface 141 of the flyer plate 140, Although FIG. 1 shows the explosive composition 150 covering the entire flyer plate 140, it should be understood that the explosive composition 150 is applied to the top surface 141 in an amount that facilities the requisite explosive output, and thus the explosive composition may only cover a portion of the top surface 141 of the flyer plate 140. The explosive composition may include pentotite, C-4, or other known explosives.

FIG. 1 shows striker assembly 130 at an angle Θ, with respect to the confinement assembly 110. As shown, the flyer plate 140 contacts the glass sheet 120 at a contacting section 142, thereby creating the angle Θ of the striker assembly 130 with respect to the confinement assembly 110. Force arrows shown at 170 indicate the direction in which the striker assembly is propelled, and in particular the direction the flyer plate 140 accelerates towards the glass sheet 120 of the confinement assembly 110, when the explosive composition 150 is ignited. FIG. 1 does not show a spacer which defines a standoff distance, but it is understood and known that one or more spacers may be employed to hold the striker assembly at an angle. The angle Θ may be any known angle used in explosion welding, as the instant embodiment operates under the same general explosion principle. According to a particular embodiment, angle Θ may be about 2 degrees to about 45 degrees. It should be understood that although in the arrangement as depicted in FIG. 1, the striker assembly 130 is at the angle Θ, with respect to the confinement assembly 110, it is also known to set up the striker assembly 130 spaced-apart and substantially parallel to the confinement assembly 100, so that the flyer plate bottom surface 139 is parallel to the upper glass surface 121 of the glass sheet 120.

Figure 2A:
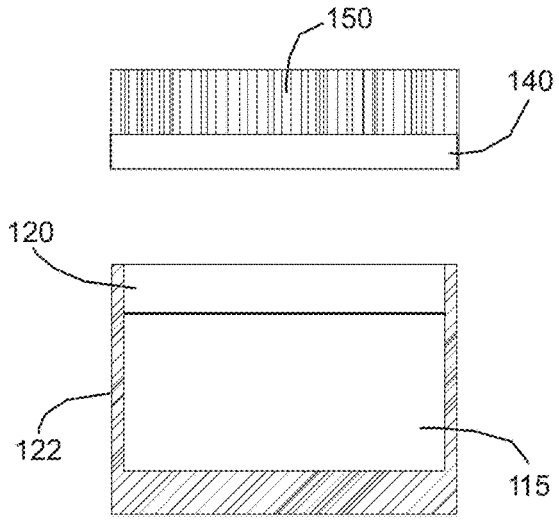
FIG. 2A is an exemplary sectional illustration of the system for hardening and compacting an elongated object, according to an embodiment of the invention.

FIG. 2A is an exemplary sectional illustration of the system 100 for hardening and compacting an elongated object, according to an embodiment of the invention in which the elongated object 115 is a flat plate. The exemplary sectional illustration of FIG. 2A is taken through AN shown in FIG. 1. FIG. 2A also shows all the accompanying elements of the confinement assembly 110 and a striker assembly 130 being planer/flat as well. Thus, according to this embodiment, each of the flyer plate 140, and the glass sheet 120 are flat. As stated above, the glass sheet 120 may be a solid sheet, or may be made up of densely packed glass particles.

FIG. 2A also shows the rigid outer shell 122 encasing both the glass sheet 120 and the flat plate 115. It should also be noted that when the explosive composition 150 is ignited, and the flyer plate is projected into the glass sheet 120, the flyer plate, in combination with the rigid outer shell 122, completely cover and encase the glass sheet 120 and the flat plate 115, to facilitate the hardening and compacting of the flat plate 115.

Figure 2B:
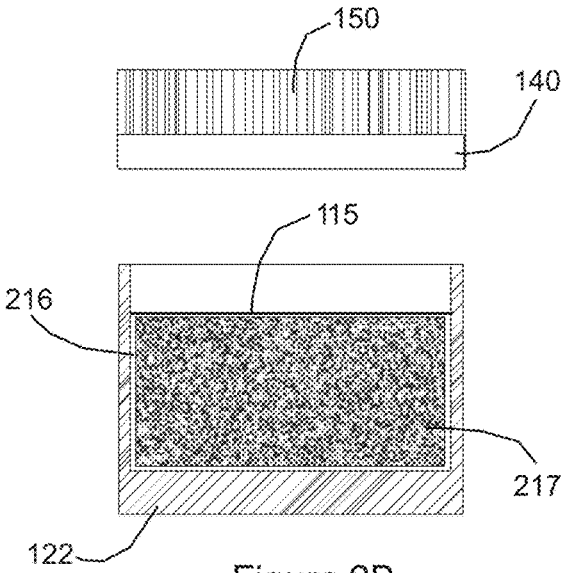
FIG. 2B is an exemplary sectional illustration of the system for hardening and compacting an elongated object, according to an embodiment of the invention.

FIG. 2B is an exemplary sectional illustration of the system 100 for hardening and compacting an elongated object, according to an embodiment of the invention in which the elongated object 115 is a polymer membrane or foil 216 filled with a powdered/granular material 217 for compaction. The pre-form powder material can also contain ceramic particles such as boron nitride, silica, alumina, and silicon carbide, and particles of cobalt and nickel. Particles of lower melting point alloys, such as aluminum and tin may be included to facilitate and preserve high hardness polymorphs formed during glass shock loading of a silicate pre-form, According to an embodiment of the invention, the powdered/granular material 217 may also include fiber materials.

As shown, the polymer membrane or foil 216 filled with the powdered/granular material 217 is laid out as a flat plate, similar to what is shown in FIG. 2A, Similarly, regarding FIG. 2B, each of the flyer plate 140, and the glass sheet 120 are flat. As outlined above, the glass sheet 120 may be a solid sheet, or may be made up of densely packed glass particles. The rigid outer shell 122 encases both the glass sheet 120 and the elongated object 115. When the explosive composition 150 is ignited, and the flyer plate is projected into the glass sheet 120, upon impact, the flyer plate in combination with the rigid outer shell 122, completely cover and encase the glass sheet 120 and the elongated object 115, which is made up of the membrane or foil 216 and the granular material 217, to facilitate the hardening and compacting of the flat plate 115, The exemplary sectional illustration of FIG. 2B is taken through AA' shown in FIG. 1.

Figure 2C:
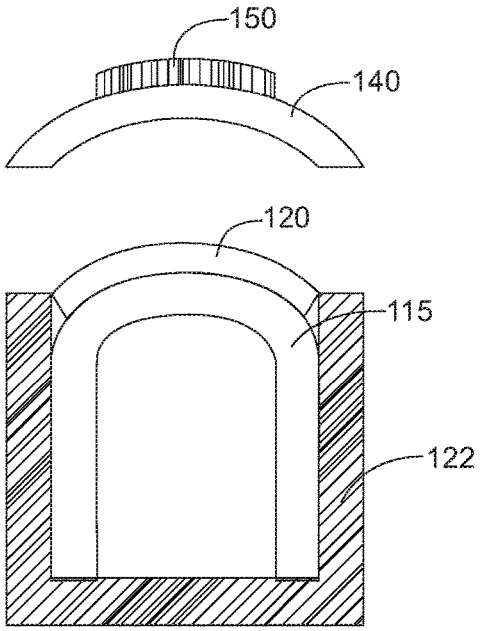
FIG. 2C is an exemplary sectional illustration of the system for hardening and compacting an elongated object, according to an embodiment of the invention.

FIG. 2C is an exemplary sectional illustration of the system 100 for hardening and compacting an elongated object, according to an embodiment of the invention in which the elongated object 115 is a curved plate that has a curvature as if a top portion of a cylinder. The exemplary sectional illustration of FIG. 2C is taken through AA' shown in FIG. 1. FIG. 2C also shows all the accompanying elements of the confinement assembly 110 and a striker assembly 130 having complementary curvatures. Thus, according to this embodiment, each of the flyer plate 140 and the glass sheet 120 are all curved as a top portion of a cylinder. As stated above, the glass sheet 120 may be a solid sheet, or may be made up of densely packed glass particles, FIG. 2C also shows the rigid outer shell 122 encasing both the glass sheet 120 and the curved plate 115. It should also be noted that when the explosive composition 150 is ignited, and the flyer plate is projected into the glass sheet 120, the flyer plate 140, in combination with the rigid outer shell 122, completely cover and encase the curved glass sheet 120 and the curved plate 115, to facilitate the hardening and compacting of the curved plate 115.

Figure 2D:
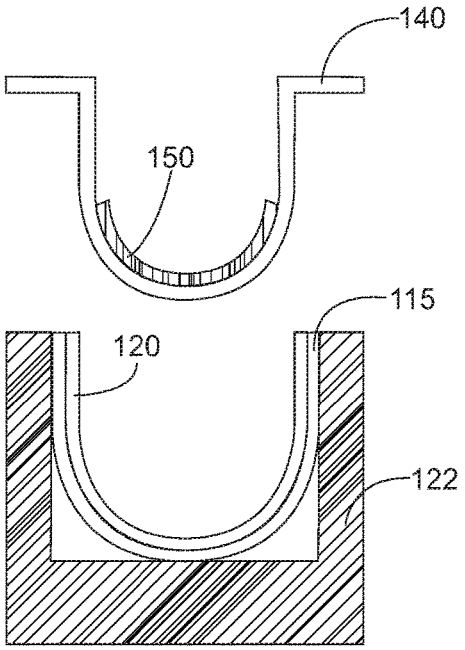
FIG. 2D is an exemplary sectional illustration of the system for hardening and compacting an elongated object, according to an embodiment of the invention.

FIG. 2D is an exemplary sectional illustration of the system 100 for hardening and compacting an elongated object, according to an embodiment of the invention in which the elongated object 115 is a curved plate that has a curvature as if a bottom portion of a cylinder. FIG. 2D is not necessarily a section of FIG. 1, but represents a reverse curvature, as compared to the illustration of FIG. 2C, and is another possible embodiment of the system 100. Thus, the illustration of FIG. 2D shows the elongated object 115 FIG. 2D also shows all the accompanying elements of the confinement assembly 110 and a striker assembly 130 having complementary curvatures, Thus, according to this embodiment, each of the flyer plate 140, and the glass sheet 120 are all curved as a bottom portion of a cylinder. As stated above, the glass sheet 120 may be a solid sheet, or may be made up of densely packed glass particles.

FIG. 2D also shows the rigid outer shell 122 encasing both the glass sheet 120 and the curved plate 115. It should also be noted that when the explosive composition 150 is ignited, and the flyer plate is projected into the curved glass sheet 120, the flyer plate 140, in combination with the rigid outer shell 122, completely cover and encase the curved glass sheet 120 and the curved plate 115, to facilitate the hardening and compacting of the curved plate 115.

In operation, the explosive composition 150 in the striker assembly 130 is ignited, projecting the flyer plate 140 at a high velocity in the direction shown by force arrows 170, impinging on the glass sheet 120. The flyer plate 140 contacts the glass while moving at speeds between 700 feet per second to about 20,000 feet per second. This generates explosive forces for several reasons. First, due to the phenomenon called "Reynolds Dilatancy" in which multiple cracks force the volume occupied to increase as the cracks rupture and expand the molecular structure. The glass experiences this Reynolds Dilatancy when impacted by the high velocity flyer plate 140, The pressure created by the ruptured glass trapped between the flyer plate 140 and the confinement assembly 110, serves to pressurize the elongated object 115, thereby hardening and compacting the object 115, Elongated objects 115 that are treated as outlined above could have different sizes and shapes, and could be solid or granular, as shown in FIGS. 2A, 2B, 2C, and 2D.

Figure 3:
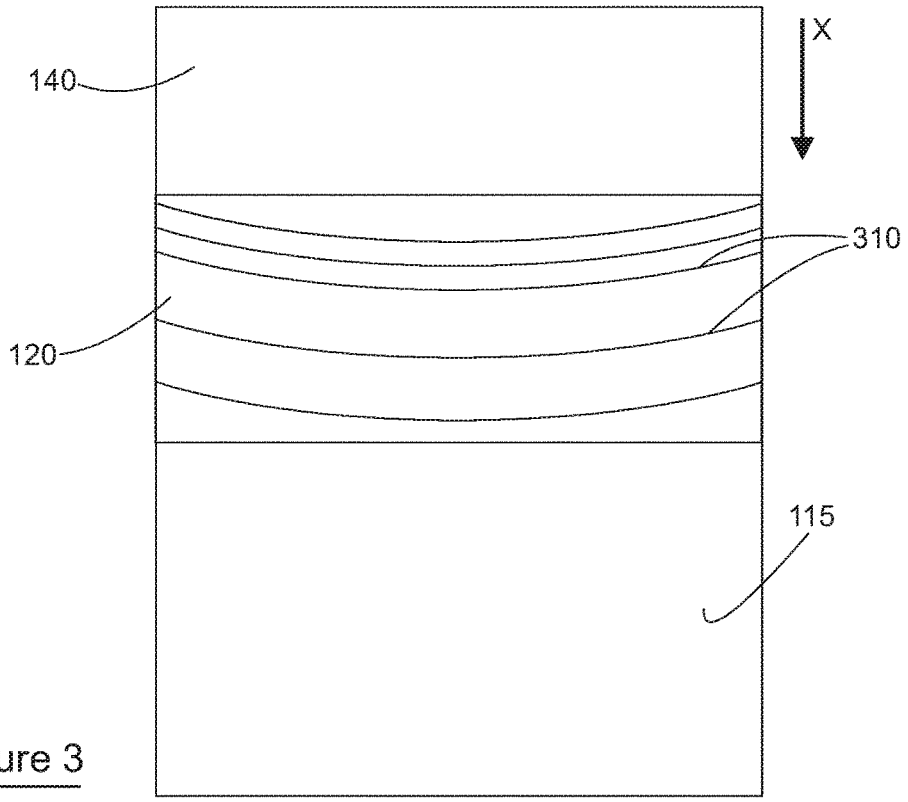
FIG. 3 is an exemplary explanatory illustration of a system 100 for hardening and compacting a cylindrical structure, according to an embodiment of the invention.

Additionally, the impact by the high velocity flyer plate 140 on the glass causes failure waves. FIG. 3 is an exemplary explanatory illustration of a system 100 for hardening and compacting a cylindrical structure, according to an embodiment of the invention. FIG. 3 shows the failure waves 310, which are waves that propagate so the glass material is intact ahead of the wave and comminuted behind the wave. In embodiments in which the glass sheet 120 comprises glass particles, it is preferred that the glass particles are more granulated, as opposed to fine powdered, in order to create more substantial failure waves 310. The large amount of kinetic energy stored ahead of the wave must then appear in comminuted form. The failure is explosive, and due to the confined area of the confinement assembly 110, creates intense pressurization forces on the elongated object 115. This hardens and compacts the object 115.

The impact by the high velocity flyer plate 140 on the glass may involve a third phenomenon which occurs when the high velocity impact of the flyer plate 140 on the glass is so forceful that coesite, stishovite, or seifertite, which are denser forms of silicate, are created. Stishovite has a density of about 4.6 gm/cc as compared to 2.6 gm/cc. It is understood that when the stishovite-type polymorphs rupture they may convert to an amorphous state. It is generally understood that polymorphs that initially form under the high pressure in the glass have smaller volume contents. Then they appear to revert to the larger volume condition, this volume change helping to create the hulking. This rebound effect increases the applied pressure via the volume expansion. It should also be understood that in response to the impact of the high velocity strikers, the coesite, stishovite, and seifertite may be created simultaneously, but at different locations. The highest pressures producing stishovite and seifertite, and areas of relatively lower pressures producing coesite.

On average, due to the different phenomenon outlined above, i.e., on account of Reynolds Dilatancy, the formation of failure waves, and the creation of coesite or stishovite, the volume expansion could be up to 40 percent or even greater. Specifically regarding stishovite, expansions of around 77 percent at high pressures may occur. It should be noted that only a limited amount of the material would likely change to this polymorph. Again, as stated above, due to the glass being confined between the flyer plate 140 and the confinement assembly 110, the explosive volume expansion created by the flyer plate 140 impacting the glass creates intense pressurization forces on the object 115. This results in the hardening and compacting of the elongated object 115, with higher and more intense pressures created with the formation of coesite, stishovite, and seifertite, producing a more hardened object 115. It should be understood that this applies to all shapes of the object 115, i.e., whether it is flat/planer or curved as shown in FIGS. 2A, 2C, and 2D, and applies regardless of whether the elongated object is solid or granular as shown in FIG. 2B.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention. For example, in addition to planar and curved elongated objects, cylindrical pipes may also be treated according to the principles outlined in the instant invention. Additionally, as opposed to the illustration in FIG. 1, it is also known to set up the striker assembly 130 spaced-apart and substantially parallel to the confinement assembly 100. The invention including the stated variations is intended to be defined by the following claims and their equivalents, in which all terms are meant in their broadest reasonable sense unless otherwise indicated.

What is claimed is:

1. A system for hardening and compacting an elongated object, the system comprising:

a confinement assembly comprising:

an elongated object having an upper surface;

a glass sheet contacting and covering the upper surface of the elongated object, the glass sheet having an upper glass surface; and a rigid outer shell encasing the glass sheet and the elongated object therewithin, wherein the rigid outer shell is open at the top so that the upper glass surface is exposed;

a striker assembly comprising;

a flyer plate having a flyer plate top surface, and a flyer plate bottom surface, wherein the flyer plate bottom surface is complementary with the upper glass surface of the glass sheet; and an explosive composition attached to at least a portion of the flyer plate top surface, wherein the flyer plate is positioned so that when the explosive composition is ignited, the flyer plate strikes the glass sheet of the confinement assembly, shattering the glass of the glass sheet to create an explosive volume expansion of the glass, which due to the glass being trapped between the flyer plate and the confinement assembly, results in compressive forces being applied to the surface of the elongated object, thereby hardening and compacting the elongated object.

2. The system for surface hardening and compacting an elongated object of claim 1, wherein the striker assembly is positioned at an angle Θ with respect to the confinement assembly.

3. The system for surface hardening and compacting an elongated object of claim 2, wherein each of the flyer plate, the glass sheet, and the elongated object, is flat.

4. The system for surface hardening and compacting an elongated object of claim 3, wherein the elongated object comprises a polymer membrane filled with a powdered material.

5. The system for surface hardening and compacting an elongated object of claim 4, wherein said powdered material comprises one or more of; boron nitride alumina, and silicon carbide, cobalt and nickel.

6. The system for surface hardening and compacting an elongated object of claim 2, wherein each of the flyer plate, the glass sheet, and the elongated object; has a cylindrical curvature.

7. A method of hardening and compacting an elongated object, the method comprising:

providing a confinement assembly comprising:

an elongated object having an upper surface;

a glass sheet contacting and covering the upper surface of the elongated object, the glass sheet having an upper glass surface; and a rigid outer shell encasing the glass sheet and the elongated object therewithin, wherein the rigid outer shell is open at the top so that the upper glass surface is exposed;

providing a striker assembly comprising:

a flyer plate having a flyer plate top surface, and a flyer plate bottom surface, wherein the flyer plate bottom surface is complementary with the upper glass surface of the glass sheet; and an explosive composition attached to at least a portion of the flyer plate top surface;

igniting the explosive composition, so that the flyer plate strikes the glass sheet of the confinement assembly, thereby creating an explosive expansion of the glass, wherein due to the limited space between the flyer plate and the confinement assembly, compressive forces are created and applied to the surface of the elongated object, thereby accomplishing said hardening and compacting of the elongated object.

8. The method of surface hardening and compacting of claim 7, further including, positioning the striker assembly at an angle Θ with respect to the confinement assembly, said positioning of the striker assembly and said ignition of the explosive combination allowing the flyer plate to impact the glass sheet at velocities between 700 feet per second to about 20,000 feet per second, so that upon impact, one or more of the following occurs:

a. multiple cracks form in the glass sheet so that the volume occupied by glass trapped between the flyer plate; the rigid open outer shell, and the elongated object increases as the cracks rupture and expand;
b. failure waves propagate through the glass sheet with large amount of kinetic energy stored ahead of the waves;
c. the glass sheet develops at least one of coesite, stishovite, or seifertite which rupture and convert to an amorphous state through a volume change;

so that the occurrences of one or more of a, b, or c, creates said explosive volume expansion of the glass, which results in said compressive forces being applied to the elongated object.

* * * * *